US008757369B2

(12) United States Patent
Portier

(10) Patent No.: US 8,757,369 B2
(45) Date of Patent: Jun. 24, 2014

(54) CONTAINER AND CAPSULE

(75) Inventor: Benoit Portier, Bourges (FR)

(73) Assignee: Airsec S.A.S., Choisy le Roi (FR)

( * ) Notice: Subject to any disclaimer, the term of this patent is extended or adjusted under 35 U.S.C. 154(b) by 1726 days.

(21) Appl. No.: 11/601,332

(22) Filed: Nov. 17, 2006

(65) Prior Publication Data

US 2007/0114140 A1 May 24, 2007

(51) Int. Cl.
*B65D 81/26* (2006.01)

(52) U.S. Cl.
USPC ..... 206/204; 206/807

(58) Field of Classification Search
USPC ..... 206/204, 701, 722, 807; 340/572.1, 340/825.49
See application file for complete search history.

(56) References Cited

U.S. PATENT DOCUMENTS

| | | | | |
|---|---|---|---|---|
| 4,813,564 | A * | 3/1989 | Cooper et al. | 215/366 |
| 6,137,413 | A * | 10/2000 | Ryan, Jr. | 340/572.8 |
| 6,226,619 | B1 * | 5/2001 | Halperin et al. | 705/23 |
| 6,483,434 | B1 * | 11/2002 | UmiKer | 340/572.1 |
| 6,523,681 | B1 * | 2/2003 | Hacikyan | 206/204 |
| 6,662,950 | B1 * | 12/2003 | Cleaver | 206/710 |
| 6,929,682 | B2 * | 8/2005 | Hurley et al. | 96/108 |
| 6,986,807 | B2 * | 1/2006 | Brunk | 96/147 |
| 7,061,382 | B2 * | 6/2006 | Claessens et al. | 340/572.8 |
| 7,126,479 | B2 * | 10/2006 | Claessens et al. | 340/572.1 |
| 2001/0054755 | A1 | 12/2001 | Kirkham | |
| 2002/0133942 | A1 * | 9/2002 | Kenison et al. | 29/841 |
| 2003/0029739 | A1 * | 2/2003 | Riemenschneider et al. | 206/204 |
| 2003/0146821 | A1 * | 8/2003 | Brandt | 340/10.1 |
| 2004/0008123 | A1 | 1/2004 | Carrender et al. | |
| 2004/0041262 | A1 * | 3/2004 | Okamoto et al. | 257/737 |
| 2004/0099744 | A1 * | 5/2004 | Cuperus et al. | 235/491 |
| 2005/0040951 | A1 * | 2/2005 | Zalewski et al. | 340/572.1 |
| 2005/0066746 | A1 * | 3/2005 | Winter | 73/861.42 |
| 2005/0189679 | A1 * | 9/2005 | Kenison et al. | 264/272.11 |
| 2006/0212096 | A1 * | 9/2006 | Stevenson | 607/60 |
| 2007/0062903 | A1 * | 3/2007 | Norman et al. | 215/274 |
| 2007/0164116 | A1 * | 7/2007 | Quemeneur | 235/487 |
| 2008/0272131 | A1 * | 11/2008 | Roberts et al. | 220/592.25 |
| 2008/0284567 | A1 * | 11/2008 | Portier et al. | 340/10.1 |
| 2009/0283595 | A1 * | 11/2009 | White et al. | 235/385 |

FOREIGN PATENT DOCUMENTS

| | | |
|---|---|---|
| DE | 42 02 044 A1 | 7/1993 |
| DE | 94 12 075 U1 | 10/1994 |
| DE | 201 05 605 U1 | 6/2001 |
| DE | 201 05 605 U1 | 7/2001 |

* cited by examiner

*Primary Examiner* — Jacob K Ackun
(74) *Attorney, Agent, or Firm* — John C. Thompson; Sandra J. Thompson

(57) ABSTRACT

The invention relates to a container, in particular for moisture-sensitive goods, with a container body and a container cover which can be opened and closed, and with a transponder which is arranged in the container cover. The transponder is covered by at least a layer of a desiccant material and is therefore protected against moisture damage which could influence the electrical characteristics of the antenna.

18 Claims, 3 Drawing Sheets

CONTAINER AND CAPSULE

CROSS-REFERENCE TO RELATED APPLICATIONS

This application claims foreign priority benefits under 35 U.S.C. §119 from European patent application Ser. No. 05 025 228.7 filed Nov. 18, 2005.

TECHNICAL FIELD

The present invention refers to a container, in particular for receiving moisture-sensitive goods, and a capsule to be received in the container characterized in that a transponder is received in said capsule body.

BACKGROUND OF THE INVENTION

Containers for receiving goods are widely used. Usually, the containers which may be vials are opaque such that the goods received in the container are not visible. To identify the good, there are inscriptions and/or pictures which are useful for selling and for the customer in order to select the goods which meet his desire.

To facilitate identification and tracking, such a container may have a bar-code which may be an EAN-code. A more sophisticated and advanced technique uses a transponder comprising a RFID chip. Such a transponder has to use an antenna which is formed on a flat disc with electric conductors being printed thereon. To allow an identification, electromagnetic waves are used. Thus, a minimum extension of the antenna is required and the antenna efficiency relies on having a specific form, such as the form of a flat spiral.

Although the use of RFID tags in a cover of such a container has already been proposed, there are several problems. With small containers, the area which may be used for receiving the tag is limited. This leads to a small antenna with a limited range of operation. On the other hand, such a transponder is subject to errors by external influences. A piece of metal arranged close to the container may influence the electromagnetic fields and the frequency selected for the transponder such that the transponder does not react properly.

To improve the independence from external influences, it has been proposed in DE GM 201 05 605 to receive the RFID chips in a mass made from polyurethane. However, during long term, the transponder of such a construction is not stable, and thus it is not reliable.

Also, it has been proposed in to incorporate a transponder directly into the plastic material of a container cover and to use a ring-shaped antenna which also acts as a capacitor and is operational as long as the container is closed. However, this structure is rather complicated to produce and requires a specific arrangement of the RFID chip. The thickness of the cover must be increased in order to safely receive the chip, and it is difficult to have the antenna in a flat arrangement, if it is not produced as a sheet covering the cover or lid from the outside. In the latter case, however, the container is not tamper-proof.

OBJECTS AND SUMMARY OF THE INVENTION

Therefor, it is an object of the invention to provide a container for receiving moisture sensitive goods, and a capsule to be received in the container characterized in that a transponder is received in said capsule body in a tamper-proof arrangement, which capsule has an improved handling and is inexpensive and easy to manufacture.

According to the invention, the transponder is arranged in the container cover but not within the plastic material thereof. Contrary thereto, it is preferably received in a hollow portion thereof and fully covered by desiccant material. Thus, it is close to the upper surface or wall of the cover but the cover plastic material has not to have an increased thickness. Advantageously, a generic and widely used cover may be selected for the present invention, and also the desiccant material may be of conventional type such that it is quite cheap and that there is no need to create specific packagings to receive the transponder.

Additionally, the protector covers the desiccant material at its lower part such that the transponder chip is safely received and double protected.

A specific advantage revises from the use of desiccant material in connection with the transponder: the transponder is closely adjacent to the desiccant material, and both sides of the antenna of the transponder are subject to the desiccating effect of the desiccant material. Thus, there will be no moisture and small water drops which could influence the electrical characteristics of the antenna. Thus, the inventive transponder is very stable even in a long-term view as the resonance frequency does not change even if the environment moisture increases. Thus, a small antenna may be used which on the other hand allows to receive a small transponder in the inner part of the container cover which receives the desiccant material.

Advantageously, the container with the transponder according to the invention is protected against moisture and any other damage. Advantageously, there will be no negative influence on the electrical characteristics of the antenna of the transponder as the desiccant material safely keeps the antenna dry.

Another important advantage is that the inventive container may be manufactured with the same tools as used for a conventional container; there is no amendment to the plastic material required.

On the other hand, according to the invention, the transponder is temper-proof protected in the container. By this, the drugs or any other goods which are received in the container may be protected against infringement and counterfeiting. Also, the RFID chip is well protected against shock and moisture such that even cheap RFID chips work reliably with the inventive container.

In this regard, it is an advantage if the transponder is supported by a protrusion and/or depression protruding from container cover. By this arrangement, a small gap is generated which on the other hand allows a drying action on both sides of the transponder.

Alternatively, if the chip of the transponder protrudes from said disc, the same effect is ensured even if the container cover has a flat inner surface.

According to another advantageous embodiment the transponder is received within a desiccant receiving space of the container cover which is filled with desiccant material, preferably at the top of said space.

According to another advantageous embodiment the transponder is adjacent to the top portion of the container cover and preferably separates the top container cover from the desiccant material.

According to another advantageous embodiment the transponder is received in a recess formed in the desiccant material, and preferably is surrounded by a portion of said desiccant material.

According to another advantageous embodiment the transponder is formed as a printed circuit board and may have any suitable form, such as a flat disc which substantially extends over the diameter of the space receiving the desiccant material.

According to another advantageous embodiment a flat cylindrical hollow space is left between the desiccant material and the container cover, and the transponder is received in said space.

According to another advantageous embodiment the desiccant material is in the form of powder or granulate which is filled into the desiccant receiving space by placing the container cover upside down, and after placing the transponder into the desiccant receiving space.

According to another advantageous embodiment the desiccant material is a formed body which leaves a hollow space for receiving the transponder, preferably at its upmost portion.

According to another advantageous embodiment the transponder is held under pressure between the desiccant material and the container cover.

According to another advantageous embodiment the protector is in snap-fit interaction with a flange formed on the container cover, and covers the desiccant material.

According to another advantageous embodiment the transponder is in frictional engagement with the desiccant material and/or the container cover.

According to another advantageous embodiment the container cover comprises a convex depression or protrusion adjacent and protruding towards the transponder.

According to another advantageous embodiment the depression is arranged centrally in said container cover and has a contact area to the transponder which preferably has a diameter of less than a third, in particular about 10 percent to 20 percent of the diameter of the transponder.

According to another advantageous embodiment the transponder comprises a RFID chip and a coil made from electrically conductive material which essentially surrounds the chip.

According to another advantageous embodiment the transponder is received in a tamper-proved manner, and is preferably invisibly received between the container cover and the desiccant material.

According to another advantageous embodiment the desiccant material contained in the desiccant receiving space desiccates the transponder.

According to another advantageous embodiment the transponder is connected with a moisture sensor which is received within the container and which upon activation measures the humidity or moisture of the inner space of the container, and by which moisture or humidity may be read out via the transponder.

Further details of the container according to the invention may be taken from the drawings, in which

DETAILED DESCRIPTION

Figure 1:
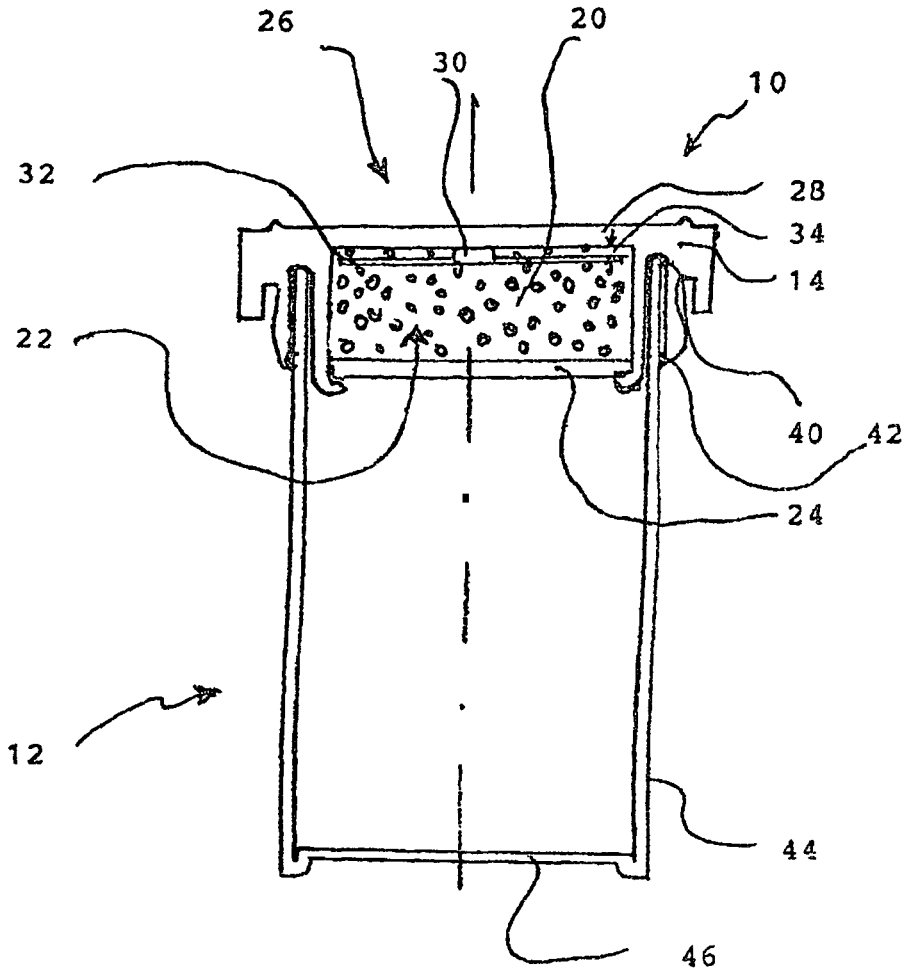
FIG. 1 shows a sectional view of a first embodiment of the container according to the invention.

The container 10 according to FIG. 1 has a container body 12 and a container cover 14. The container is intended for taking up moisture-sensitive goods such as drugs. The drugs must be kept dry, and, to this extent, a desiccant material 20 is received within a hollow cylindrical space 22 which is provided in the container cover.

A protector 24 closes the hollow space 22. The protector 24 is in the form of a disc and consists of any suitable material which is strong enough for the desired protection but on the other hand permeable for moisture and gas. A sieve with supporting structure, a grid with small grid openings but also cardboard etc may be used.

According to the invention, a transponder 26 is received within the hollow space 22 and preferably adjacent to the plastic material of the cover 14 which forms an upper wall 28 closing the hollow space 22 upwardly.

The transponder 26 comprises a RFID chip 30 and a printed circuit board 32 which has an antenna printed on it. The RFID chip 30 has a thickness which is about triple the thickness of board 32. Thus, as the upper wall 28 has a flat inner surface, there is a small gap 34 between the upper wall 28 and the board or disc 32 which is intended for the desiccant material being operational also in the upper part of board 32. By this, any moisture which might collect there is safely taken up.

Thus, preferably, the gap 34 is filled with dry and plain air while according to the drawing of FIG. 1 parts of the desiccant material 20 may be received in gap 34.

The container 10 is constructed in a suitable manner allowing a sealed arrangement between cover 14 and body 12. To this end, line sealings 40 and 42 are arranged between the cover and the rib surrounding the upper body opening.

According to a different embodiment, the container wall 44 and the container bottom 46 may be provided with layers of desiccant material as is known from EP 454976.

Figure 2:
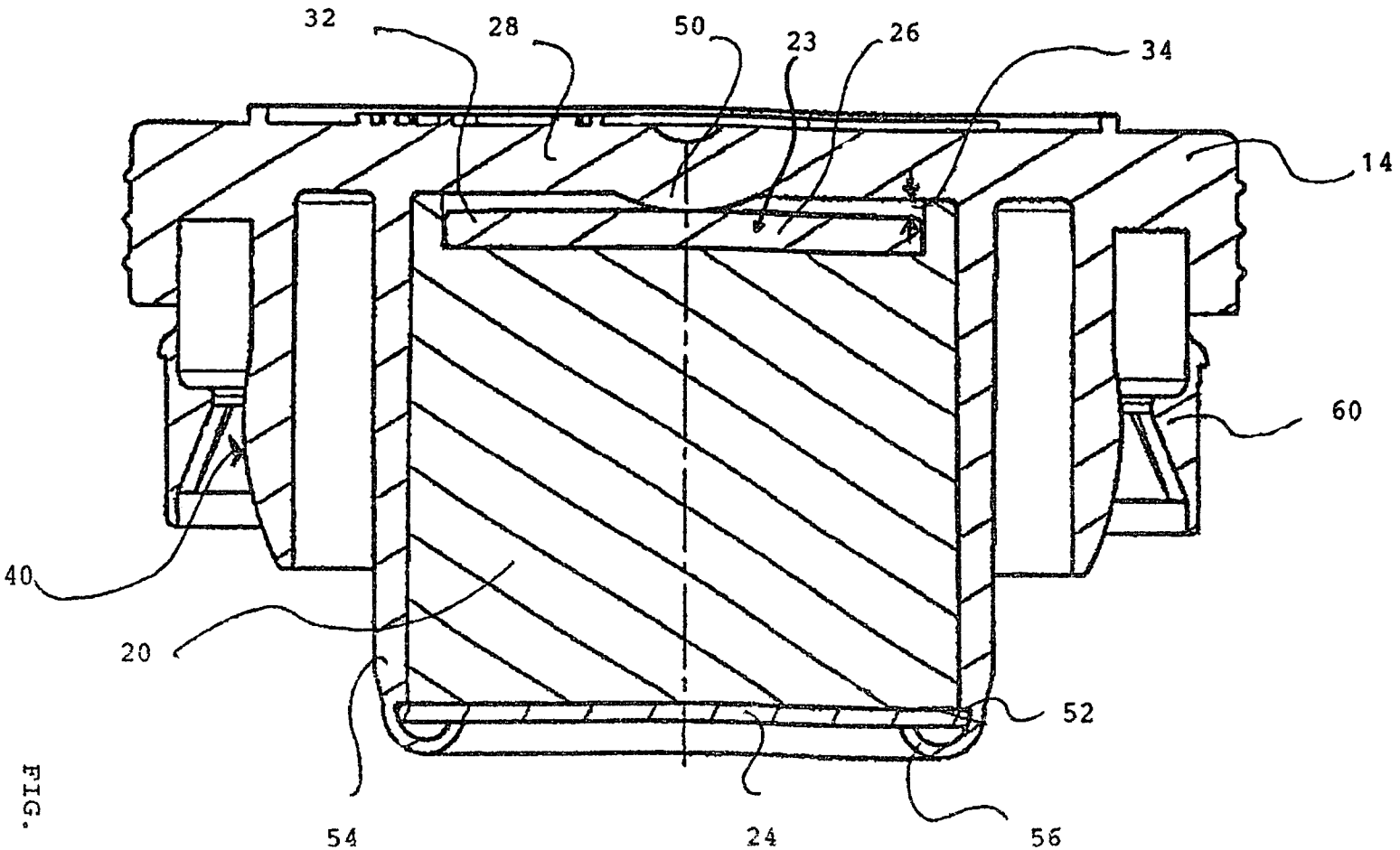
FIG. 2 shows a second embodiment of the container according to the invention shown as far as the container cover is concerned.

Another embodiment of the container according to the invention is in part shown in FIG. 2. This container cover 40 comprises a transponder 26 which has the form of a flat disc 32 i.e. without any protruding chip. In this embodiment, a central depression 50 protrudes downwardly from upper wall 28 of container cover 14. This ensures the desired gap 34.

In this embodiment, the desiccant material 20 is a pre shaped press or solid body 20 which fits into the hollow space of the cover 14, the solid body having a recess 23 to receive the transponder 26.

As may be taken from FIG. 2, the protector 24 is received at a shoulder 52 on a flange 54 of the container cover 14. The protector 24 is hold in place by resilient support fingers 56. Even if the overall volume of the desiccant material 20 increases through taking up moisture, the resilient support fingers 56 will ensure that protector 24 is kept in place. In this design the transponder 26 is held under pressure between the cover and the desiccant.

FIG. 2 also shows a tamper-barrier 60 which is intended to be broken if the container cover is opened. The container body has an upper and outwardly extending flange surrounding its upper opening, and a line sealing 40 is provided close to this opening.

As previously noted, the transponder (26) is connected with a moisture sensor which is received within the container (10) and which upon activation measures the humidity or moisture of the inner space of the container (10), and by which moisture or humidity may be read out via the transponder (26).

Figure 3:
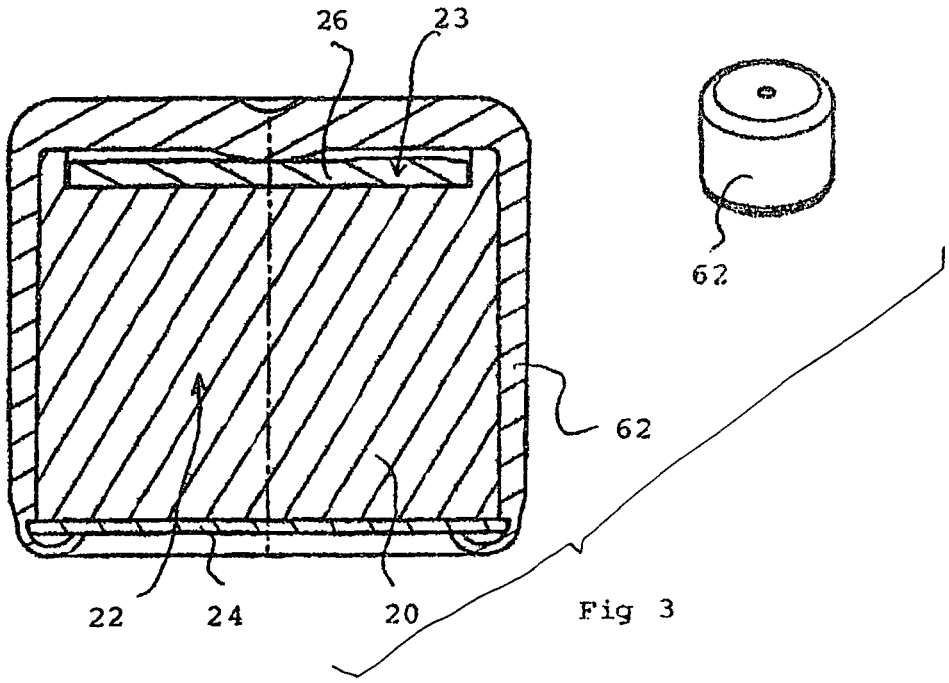
FIG. 3 shows a third embodiment of a capsule to be received in a container according to the invention.

FIG. 3 shows another embodiment of the invention, being formed as a capsule which is shown in section on the left side and in a perspective view on the right side of FIG. 3. The capsule 62 is provided with desiccant material 20 and is formed like the middle portion of the container cover 14 of FIGS. 1 and 2. The protector 24 closes the hollow space 22, and the desiccant material has a recess 23 to receive a transponder 26.

Such a capsule 62 may be used in a container for receiving drugs, or a small bottle entity. It may also be received in the container cover 14 which then has an enlarged hollow space 22 to receive the capsule 62. In this case, the wall thickness of the capsule may be reduced. Alternatively, it may be attached to a container cover 14, e.g. by means of a snap-fit connection.

In another embodiment of the invention, the capsule has an outer diameter which exactly fits to the inner diameter of the container body. In this case, the capsule may be pushed into the container upside-down, and it is preferred that the protector has a surface which resists the drugs.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A Container comprising:

a container body (12) for receiving moisture sensitive goods;

a container cover (14) for closing the container body, which cover which can be opened and closed;

a transponder (26) arranged in the container cover (14);

a layer of a desiccant material (20) which covers the transponder; and a gas permeable protector (24) which covers the desiccant material.

2. Container according to claim 1, characterized in that the transponder (26) is received within a desiccant receiving space of the container cover (14) which is filled with the desiccant material (20) at the top of said space.

3. Container according to claim 1, characterized in that the transponder (26) is adjacent to the top portion of the container cover (14) and separates the top container cover from the desiccant material (20).

4. Container according to claim 1, characterized in that the transponder (26) is formed as a disc which substantially extends over the diameter of the space receiving the desiccant material (20).

5. Container according to claim 1, characterized in that a flat cylindrical hollow space (22) is left between the desiccant material (20) and the container cover (14), and that the transponder (26) is received in said space.

6. Container according to claim 2, characterized in that the desiccant material (20) is in the form of powder or granulate which is filled into the desiccant receiving space by placing the container cover (14) upside down, and after placing the transponder (26) into the desiccant receiving space.

7. Container according to claim 1, characterized in that the desiccant material (20) is a formed body which leaves a hollow space (22) for receiving the transponder (26) at its upmost portion.

8. Container according to claim 1, characterized in that the transponder (26) is held under pressure between the desiccant material (20) and the container cover (14).

9. Container according to claim 1, characterized in that the protector (24) is in snap-fit interaction with a flange (54) formed on the container cover (14), and covers the desiccant material (20).

10. Container according to claim 1, characterized in that the transponder (26) is in frictional engagement with the desiccant material (20) and/or the container cover (14).

11. Container according to claim 1, characterized in that the container cover (14) comprises a convex depression or protrusion (50) adjacent to and protruding towards the transponder (26).

12. Container according to claim 11, characterized in that the depression or protrusion (50) is arranged centrally in said container cover (14) and has a contact area to the transponder (26) which has a diameter of less than a third, in particular about 10 percent to 20 percent of the diameter of the transponder (26).

13. Container according to claim 1, characterized in that the transponder (26) comprises a RFID chip (30) and a coil made from electrically conductive material which essentially surrounds the chip (30).

14. Container according to claim 1, characterized in that the transponder (26) is received in a tamper-proved manner, and is invisibly perceived between the container cover (14) and the desiccant material (20).

15. Container according to claim 1, characterized in that the desiccant material (20) contained in the desiccant receiving space desiccates the transponder (26).

16. Container according to claim 1, wherein the transponder (26) is received in a recess (23) formed in the desiccant material (26).

17. Container according to claim 16, wherein the desiccant material is a pre-shaped press or solid body having the recess for receiving the transponder.

18. A capsule to be received in a container which receives moisture sensitive goods, the capsule comprising:

a capsule body (62);

a transponder (26) received in the capsule body;

a desiccant material (20) which covers the transponder; and a moisture and gas permeable protector (24) which covers the desiccant material.

* * * * *